US010030821B2

(12) United States Patent
Peeters

(10) Patent No.: US 10,030,821 B2
(45) Date of Patent: Jul. 24, 2018

(54) WATERTIGHT LUMINAIRE ARRANGEMENT

(71) Applicant: PHILIPS LIGHTING HOLDING B.V., Eindhoven (NL)

(72) Inventor: Henricus Marie Peeters, Baarlo (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 102 days.

(21) Appl. No.: 14/347,400

(22) PCT Filed: Oct. 1, 2012

(86) PCT No.: PCT/IB2012/055253
§ 371 (c)(1),
(2) Date: Mar. 26, 2014

(87) PCT Pub. No.: WO2013/054225
PCT Pub. Date: Apr. 18, 2013

(65) Prior Publication Data

US 2014/0240996 A1 Aug. 28, 2014

Related U.S. Application Data

(60) Provisional application No. 61/545,293, filed on Oct. 10, 2011.

(51) Int. Cl.
*F21K 99/00* (2016.01)
*F21V 21/02* (2006.01)
(Continued)

(52) U.S. Cl.
CPC ..... *F21K 9/30* (2013.01); *F21K 9/20* (2016.08); *F21V 21/02* (2013.01); *F21V 31/005* (2013.01);
(Continued)

(58) Field of Classification Search
CPC ..... F21V 15/00; F21V 15/01; F21V 17/00; F21V 17/04; F21V 21/001;
(Continued)

(56) References Cited

U.S. PATENT DOCUMENTS 2,016,722 A * 10/1935 Levin ..... 362/280
2,135,534 A * 11/1938 Roper ..... H01R 33/46 362/382
(Continued)

FOREIGN PATENT DOCUMENTS

CN 101142653 A 3/2008
CN 201177221 Y * 1/2009 ..... F21V 17/06
(Continued)

OTHER PUBLICATIONS

Machine translation of CN201177221Y retrieved from Espacenet.*

*Primary Examiner* — Jong-Suk (James) Lee
*Assistant Examiner* — Colin Cattanach
(74) *Attorney, Agent, or Firm* — Akarsh P. Belagodu

(57) ABSTRACT

A luminaire arrangement (30) comprising a luminaire holder (10) and a luminaire module (20). The luminaire holder (10) is arranged to be attached to a ground plane (32) and comprises electrical circuitry connectors (12), grommet seals (14) provided on said electrical circuitry connectors (12), and a shield (18). The luminaire module (20) comprises a covering (24) and is arranged to be received in the luminaire holder (10). The shield (18) and the covering (24) are arranged to form a sealing arrangement between the luminaire holder (10) and the luminaire module (20), when the luminaire module (20) is received in the luminaire holder (10).

8 Claims, 6 Drawing Sheets

(51) Int. Cl.

| | |
|---|---|
| ***F21K 9/20*** | (2016.01) |
| *F21W 131/401* | (2006.01) |
| *F21V 31/04* | (2006.01) |
| *F21V 31/03* | (2006.01) |
| *F21V 31/00* | (2006.01) |
| *F21W 111/04* | (2006.01) |
| *F21Y 115/10* | (2016.01) |

(52) U.S. Cl.
CPC ..... *F21V 31/00* (2013.01); *F21V 31/03* (2013.01); *F21V 31/04* (2013.01); *F21W 2111/04* (2013.01); *F21W 2131/401* (2013.01); *F21Y 2115/10* (2016.08)

(58) Field of Classification Search
CPC .... F21V 21/0015; F21V 21/006; F21V 31/00; F21V 31/005; F21K 9/30; F21Y 2101/02
See application file for complete search history.

(56) References Cited

U.S. PATENT DOCUMENTS 2,730,611 A * 1/1956 Black ..... 362/485
4,712,163 A * 12/1987 Oxley ..... 362/23.18
4,829,407 A * 5/1989 Bushell et al. ..... 362/23.18
4,996,635 A * 2/1991 Olsson et al. ..... 362/477
5,193,898 A * 3/1993 Maglica ..... F21L 4/005 362/183
5,578,863 A 11/1996 De Poorter
5,821,695 A * 10/1998 Vilanilam et al. ..... 315/58
5,909,062 A * 6/1999 Krietzman ..... H02J 9/061 307/150
7,588,359 B2 * 9/2009 Coushaine ..... B60Q 1/2696 362/540
8,038,328 B2 * 10/2011 Lin ..... F21S 48/328 362/294
8,167,468 B1 * 5/2012 Olsson et al. ..... 362/477
8,342,711 B2 * 1/2013 Lin ..... F21K 9/00 362/249.01
2002/0024810 A1 * 2/2002 Nagakura ..... 362/263
2003/0035284 A1 * 2/2003 Maglica ..... F21L 4/005 362/188
2003/0210542 A1 * 11/2003 Maglica ..... F21L 4/005 362/158
2004/0070990 A1 * 4/2004 Szypszak ..... G01N 21/8806 362/555
2004/0130892 A1 * 7/2004 Galli ..... F21L 4/027 362/187
2004/0190286 A1 * 9/2004 Chapman ..... F21L 4/027 362/171
2005/0036305 A1 * 2/2005 Kersey ..... A61H 33/6063 362/149
2005/0099805 A1 * 5/2005 Chapman ..... F21L 4/027 362/184
2006/0176686 A1 * 8/2006 McVicker ..... 362/183
2007/0058377 A1 * 3/2007 Zampini et al. ..... 362/372
2007/0137544 A1 * 6/2007 MacDonald ..... B63B 45/02 114/173
2007/0209566 A1 * 9/2007 MacDonald et al. ..... 114/177
2008/0239704 A1 * 10/2008 Lin ..... F21S 8/00 362/101
2009/0154164 A1 * 6/2009 Hsu ..... F21S 8/00 362/267
2009/0242922 A1 * 10/2009 Lin ..... F21V 31/005 257/99
2009/0296417 A1 * 12/2009 Luo ..... F21K 9/00 362/487
2010/0002435 A1 * 1/2010 Rash ..... B63B 45/02 362/235
2010/0315815 A1 * 12/2010 Lin ..... F21K 9/00 362/249.01
2010/0315823 A1 * 12/2010 Lin ..... F21S 48/328 362/368
2010/0328960 A1 * 12/2010 Wang ..... F21V 29/004 362/373
2011/0063837 A1 * 3/2011 Rizkin ..... F21V 19/001 362/235
2011/0254450 A1 * 10/2011 Bergholz ..... F21V 19/0015 315/121
2012/0224375 A1 * 9/2012 Zaderej ..... F21K 9/00 362/249.02

FOREIGN PATENT DOCUMENTS

CN 201177221 Y 1/2009
CN 201285018 Y 8/2009
EP 1376004 A2 1/2004
FR 1436060 A 4/1966
GB 575890 A 3/1946
JP 2006277985 A 10/2006
JP 2011108587 A 6/2011
WO WO 2009057178 A1 * 5/2009 ..... B60Q 1/2615

* cited by examiner

WATERTIGHT LUMINAIRE ARRANGEMENT

FIELD OF THE INVENTION

The present invention relates to the field of luminaire modules and in particular to a luminaire arrangement consisting of a luminaire holder and a luminaire module. More particularly, the present invention relates to the field of LED driven luminaire modules.

BACKGROUND OF THE INVENTION

An increasing number of LED driven luminaires are on the market today. Many of these systems are equipped with LED modules, which comprise a plurality of light emitting diodes, LEDs. The LED module is typically inserted or mounted in a lamp holder.

The industry and other actors in this area are currently cooperating with the aim of developing standard specifications for the interfaces of LED light engines. An LED light engine is an LED module with defined interfaces that do not depend on the type of LED technology used inside the light engine. For example standard specifications for mounting and electrically connecting LED modules may define the electrical, mechanical and also thermal interfaces and enable interchangeability between products made by diverse manufacturers. In other words, this allows customers to interchange LED modules of brand A with brand B. In this way there is no need to exchange sockets or luminaires when a customer wants to replace an LED module.

The interchangeability is achieved by defining interfaces for a variety of application-specific light engines. The standard speciafications may cover the physical dimensions, as well as the photometric, electrical and thermal behavior of LED light engines.

The lighting standards can be implemented in many areas: lighting for homes, retail, offices and also outdoor applications. In many of these applications there is often a requirement for high Ingress Protection, IP. The IP rating classifies and rates the degrees of protection provided against the intrusion of solid objects (including body parts like hands and fingers), dust, accidental contact, and water in mechanical casings and electrical enclosures. The IP rating standard aims to provide more detailed information than vague marketing terms such as waterproof.

One disadvantage of the standards discussed above is that the interface does not incorporate ingress protection. Therefore it is entirely up to the manufacturer of the Luminaire to provide the IP protection when making the design. Further, it is often difficult to realize high IP rating without making a bulky design. In addition, another disadvantage is that extra light loss will occur because the LED module must be fully enveloped by an ingress protective cover.

For these types of applications, where such lighting standards are implemented, there is therefore a need for a compact and easy solution of how to realize an LED Luminaire having both high IP rating and optimal luminaire efficiency.

SUMMARY OF THE INVENTION

In view of the above it is desirable to provide a luminaire arrangement that can facilitate interchangeability between different brands of luminaire modules and luminaire holders. It is also desirable to provide a luminaire arrangement having high IP protection abilities, while maintaining optimal luminaire efficiency, thus avoiding extra light loss.

In addition, it is desirable to provide a luminaire arrangement that can incorporate high ingress protection without making a bulky design.

Generally, the above objectives are achieved by arrangements and devices according to the attached independent claims.

It is an objective of the current invention to provide an arrangement which solves or at least mitigates the issues addressed above.

According to a first aspect of the invention, this and other objects are achieved by a luminaire arrangement comprising a luminaire holder being arranged to be attached to a ground plane and comprising electrical circuitry connectors, grommet seals provided on said electrical circuitry connectors, and a shield, and a luminaire module comprising a covering and being arranged to be received in said luminaire holder, wherein said shield and said covering are arranged to form a sealing engagement between said luminaire holder and said luminaire module, when said luminaire module is received in said luminaire holder.

Advantageously such a luminaire arrangement may provide an improved interface between a luminaire module and luminaire holder. In this way, the disadvantages of the standards are removed. In other words, the luminaire arrangement according to the present invention incorporates ingress protection in such a way that a watertight protection is formed once the luminaire module is inserted into the luminaire holder.

Another advantage of the inventive luminaire arrangement is that high ingress protection may be achieved in a small and compact design. There is therefore no need for the luminaire builder to make a bulky design by adding an additional cover in order to achieve high IP rating.

The main element of the invention is that the lamp holder, or the luminaire holder, takes care of a watertight connection between ground plane and lamp holder and the watertight connection of the mains wires. For this purpose a shield is added to the lamp holder. The LED module, or the luminaire module, is fitted with an extra skirt. The skirt and shield form a watertight protection once the LED module is inserted in the holder. The skirt does not block or cover the light emitting opening of the LED module. In this way a watertight luminaire can be built with an optical efficiency of 100%. No additional cover is needed. An element of the present invention is that part of the Ingress protection is realized in the lamp holder and part in the interface between lamp holder and LED module. It is also possible to achieve compatibility between low IP rated and high IP rated luminaire holder and luminaire module. The Ingress protection is provided by a skirt being attached to the LED module and by protective rings being mounted onto the lamp holder/socket. Further, three rubber seals can be used to make a watertight interface: a sealing ring between the shield on the luminaire holder and a ground plane; grommet like seals on the cable entry and an O-ring between the skirt on the LED module and the shield on the luminaire holder.

In an embodiment, the luminaire arrangement may further comprise a seal positioned between the shield and the ground plane, the seal being arranged to form a sealing engagement between the luminaire arrangement and the ground plane.

In this way, the luminaire holder, comprising the shield, takes care of the Ingress protected, or watertight, connection between the ground plane and the luminaire holder.

In an embodiment, the luminaire arrangement may comprise a light emitting aperture and the sealing engagement between the luminaire holder and the luminaire module may be formed such that the light emitting aperture remains uncovered, when the luminaire module is received in the luminaire holder.

In this way, the luminaire module, through its covering, and the luminaire holder, through its shield, both take care of the watertight protection once the luminaire module is inserted into the luminaire holder.

In an embodiment the luminaire module may be a light emitting diode module, LED module, comprising a plurality of light emitting diodes.

In an embodiment, at least one gasket, or a so called O-ring, may be attached to the shield of the luminaire holder. This embodiment may naturally further improve the IP rating.

In another embodiment, at least one gasket may be attached to the covering of the luminaire module, whereby the IP rating also may be further improved.

In an embodiment, the covering on the luminaire module may be an integrated covering arrangement comprising the covering and at least one gasket. In this way, the number of required components may be significantly reduced.

In an embodiment, when the luminaire arrangement comprises a seal positioned between the shield and the ground plane, the shield on the luminaire holder may be an integrated shield arrangement comprising the grommet seals, the seal, and at least one gasket.

In yet another embodiment of the luminaire arrangement, at least one gasket may be arranged between the luminaire holder and the ground plane.

In another embodiment, at least one gasket may be attached to the ground plane.

According to a second aspect of the invention, the above object and other objects are achieved by a luminaire holder being arranged to be attached to a ground plane and comprising electrical circuitry connectors, grommet seals provided on said electrical circuitry connectors, and a shield, said luminaire holder being arranged to form part of a luminaire arrangement according to any of the embodiments of the first aspect of the present invention.

According to a third aspect of the invention, the above object and other objects are achieved by a luminaire module being arranged to emit light through a light-emitting aperture and to be received in a luminaire holder and comprising a covering, said luminaire module being arranged to form part of a luminaire arrangement according to any of the embodiments of the first aspect of the present invention.

In an embodiment, the luminaire module may be arranged to be received in a luminaire holder according to the second aspect of the invention.

In another embodiment, the luminaire holder may be arranged to receive a luminaire module according to the third aspect of the present invention.

It is noted that the invention relates to all possible combinations of features recited in the claims. Thus, all features and advantages of the first aspect likewise apply to the second and third aspects, respectively.

BRIEF DESCRIPTION OF THE DRAWINGS

The various aspects of the invention, including its particular features and advantages, will be readily understood from the following detailed description and the accompanying drawings, in which.

DETAILED DESCRIPTION

Figure 1:
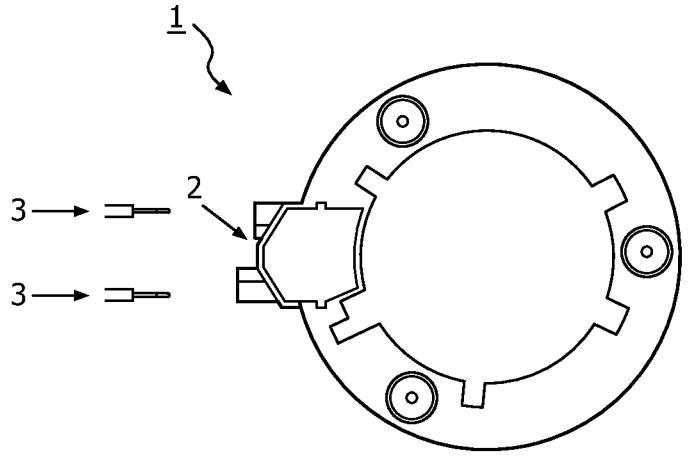
FIG. 1 is a schematic top view of a prior art luminaire holder.

The present invention will now be described more fully hereinafter with reference to the accompanying drawings, in which currently preferred embodiments of the invention are shown. The present invention may, however, be embodied in many different forms and should not be construed as limited to the embodiments set forth herein; rather, these embodiments are provided for thoroughness and completeness, and to fully convey the scope of the invention to the skilled addressee. Like reference characters refer to like elements throughout.

FIG. 1 is a schematic top view of a prior art luminaire holder 1 comprising an electrical circuitry connector 2, to which mains cables 3 can be connected.

Figure 2:
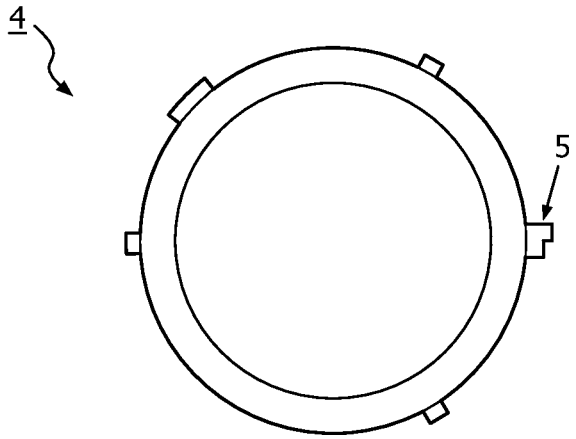
FIG. 2 is a schematic top view of a prior art luminaire module.

FIG. 2 is a schematic top view of a prior art luminaire module 4, comprising a mains connection 5. The luminaire module 4 can be arranged to be received in the prior art luminaire holder 1 illustrated in FIG. 1.

Figure 3:
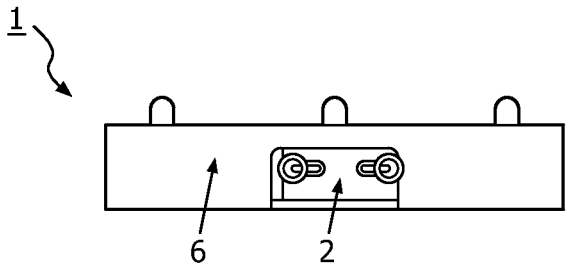
FIG. 3 is a schematic side view of a prior art luminaire holder.

FIG. 3 is a schematic side view of the prior art luminaire holder 1 illustrated in FIG. 1. In FIG. 3 it can be seen that the prior art luminaire holder 1 comprises a base 6, upon which an electrical connector 2 can be attached.

Figure 4:
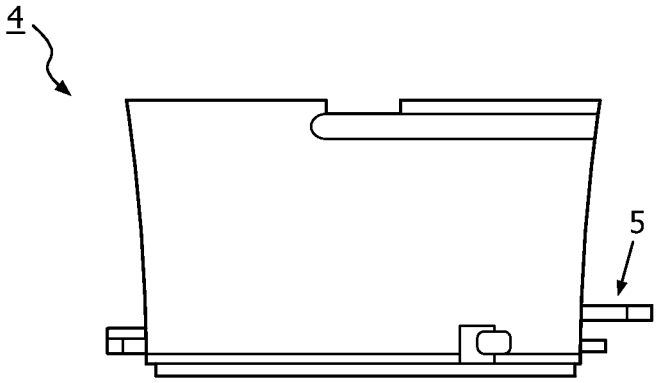
FIG. 4 is a schematic side view of a prior art luminaire module.

FIG. 4 is a schematic side view of the prior art luminaire module 4 comprising a mains connection 5.

Figure 5:
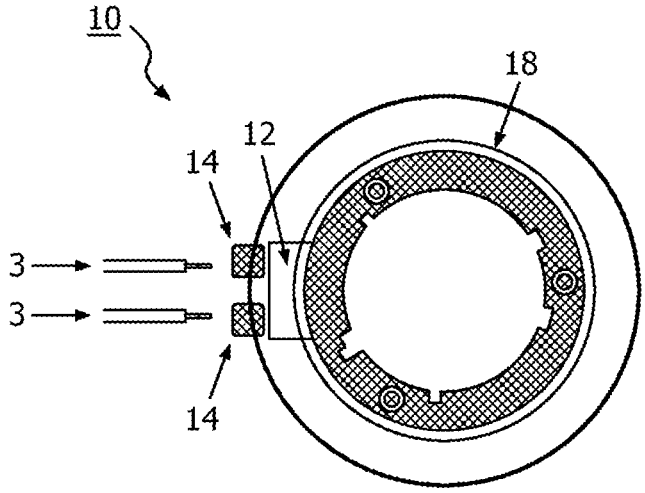
FIG. 5 is a schematic top view of a luminaire holder according to an embodiment of the present invention.

FIG. 5 is a schematic top view of a luminaire holder 10 according to the present inventive concept. The luminaire holder 10 comprises an electrical circuitry connector 12 upon which grommet seals 14 may be provided. The grommet seals 14 allow for a watertight connection of the mains wires 16. The luminaire holder 10 further comprises a shield 18, which can be arranged around the luminaire holder 10. The luminaire holder 10 can further be arranged to be attached to a ground plane.

Figure 6:
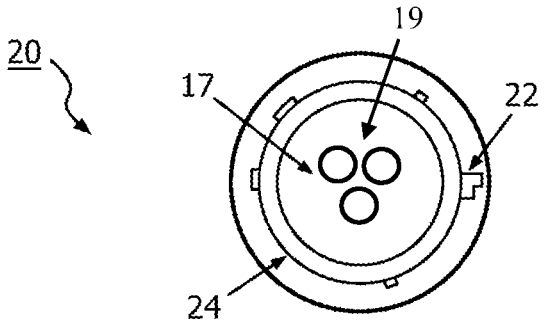
FIG. 6 is a schematic top view of a luminaire module according to an embodiment of the present invention.

FIG. 6 is a schematic top view of a luminaire module 20 according to the present inventive concept. The luminaire module 20 comprises an electrical connector 22 and a light emitting aperture 17. The luminaire module further comprises a covering 24. The covering 24 can be arranged around the luminaire module like a skirt.

Figure 7:
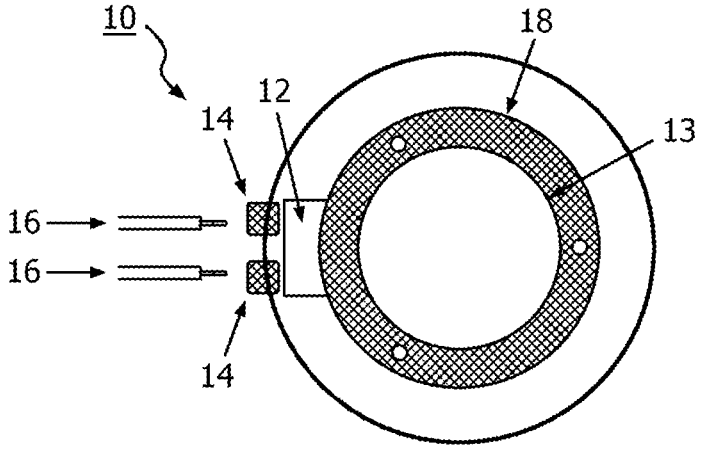
FIG. 7 is a schematic bottom view of a luminaire holder according to an embodiment of the present invention.

FIG. 7 is a schematic bottom view of the luminaire holder 10. The luminaire holder 10 comprises a seal 13 arranged between the luminaire holder 10 and a ground plane to which the luminaire holder 10 can be attached. The seal 13 can be positioned between the shield 18 and the ground plane. The luminaire holder 10 can further comprise at least one other seal arranged on the seal 13. The at least one other seal can be a flat rubber ring which can provide a watertight interface between the luminaire holder 10 and the ground plane.

Figure 8:
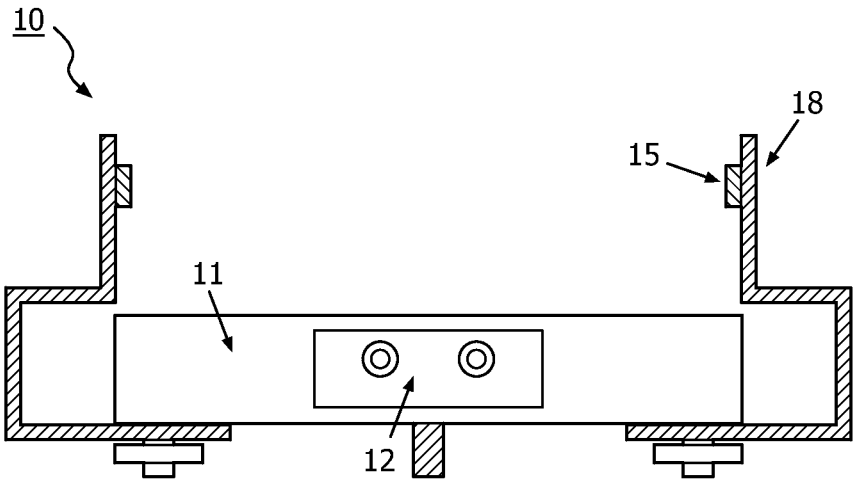
FIG. 8 is a schematic side view of a luminaire holder according to an embodiment of the present invention.

FIG. 8 is a schematic side view of the luminaire holder 10. The luminaire holder 10 comprises a base 11 upon which an electrical circuitry connector 12 is arranged. The luminaire holder 10 further comprises a shield 18 upon which a gasket 15 can be arranged. The gasket can be an O-ring. The luminaire holder 10 can also comprise grommet seals 14 arranged on the mains connector allowing for a watertight connection of the mains wires.

Generally, the luminaire holder is able to connect the luminaire module to the mains supply.

Figure 9:
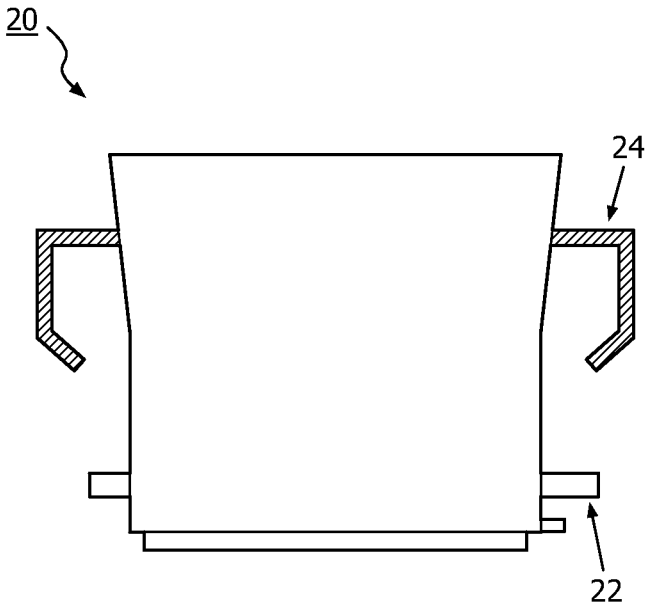
FIG. 9 is a schematic side view of a luminaire module according to an embodiment of the present invention.

FIG. 9 is a schematic side view of the luminaire module 20. The luminaire module 20 comprises a covering 24, which can be arranged around the luminaire module 20 like a skirt. The luminaire module 20 further comprises an electrical connector 22.

The luminaire module can be a light emitting diode module, LED module, comprising a plurality of light emitting diodes 19, as shown, for example, in FIG. 6.

Advantageously, the luminaire module can have an integrated driver, removing the need to connect an additional LED driver to it.

The luminaire module may have different color temperatures, for example 2700K, 3000K, 4000K, which all may be dimmable.

Figure 10:
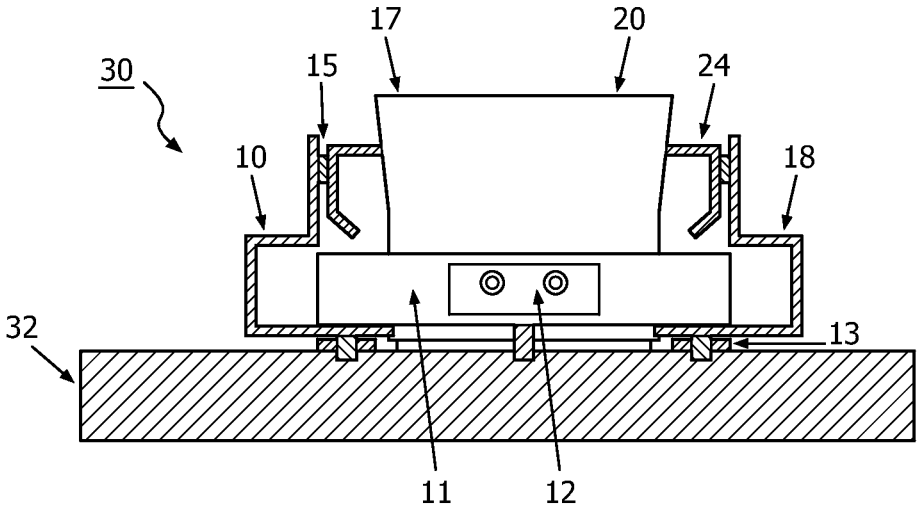
FIGS. 10-12 illustrate luminaire arrangements according to embodiments of the present invention.

FIG. 10 is a schematic side view of an embodiment of a luminaire arrangement 30 according to the present inventive concept. The luminaire arrangement 30 comprises a luminaire holder 10, like the one illustrated in FIG. 8, and a luminaire module 20, like the one illustrated in FIG. 9. The luminaire holder 10 comprises a base 11 upon which an electrical circuitry connector 12 is arranged. The luminaire holder 10 further comprises a shield 18 arranged on the base 11. The luminaire module 20 comprises a covering 24. The shield 18 and the covering 24 are arranged to form a sealing engagement between the luminaire holder 10 and the luminaire module 20, when the luminaire module 20 is received in the luminaire holder 10.

Further, the luminaire module 20 comprises a light emitting aperture 17. The covering 24 is arranged such that the sealing engagement between the luminaire holder 10 and the luminaire module 20 is formed in a way so that the light emitting aperture remains uncovered, when the luminaire module 20 is received in the luminaire holder 10. This enables a sealing engagement with high Ingress protection whilst at the same time avoiding extra light loss.

To continue, the gasket 15 can be arranged either on the covering 24 or on the shield 18. The gasket 15 further improves the sealing engagement between the luminaire holder 10 and the luminaire module 20, when the two are connected together.

The luminaire arrangement 30 shown in FIG. 10 further comprises a seal 13 positioned between the shield 18 and a ground plane 32. The seal 13 can be arranged to form a sealing engagement between the luminaire arrangement 30 and the ground plane 32. In this way, the luminaire arrangement takes care of a watertight connection between the luminaire holder 10 and the ground plane.

Figure 11:
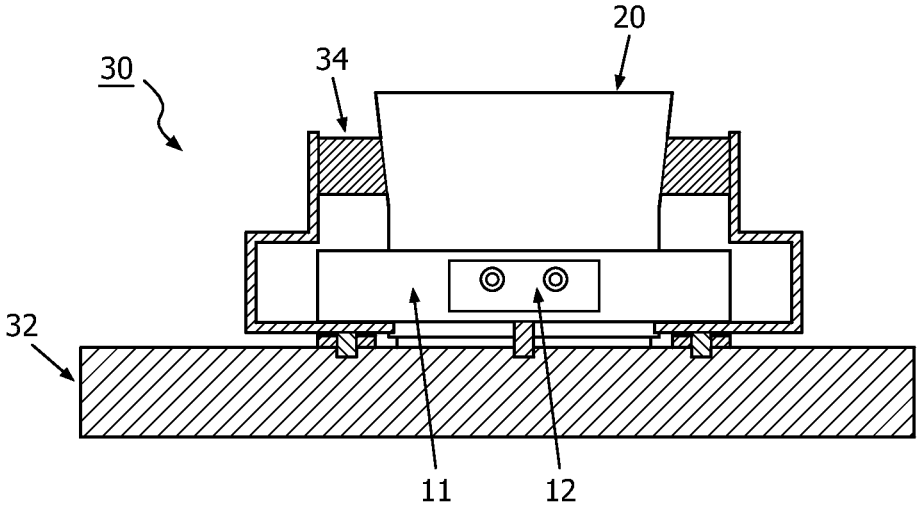
Figure 12:
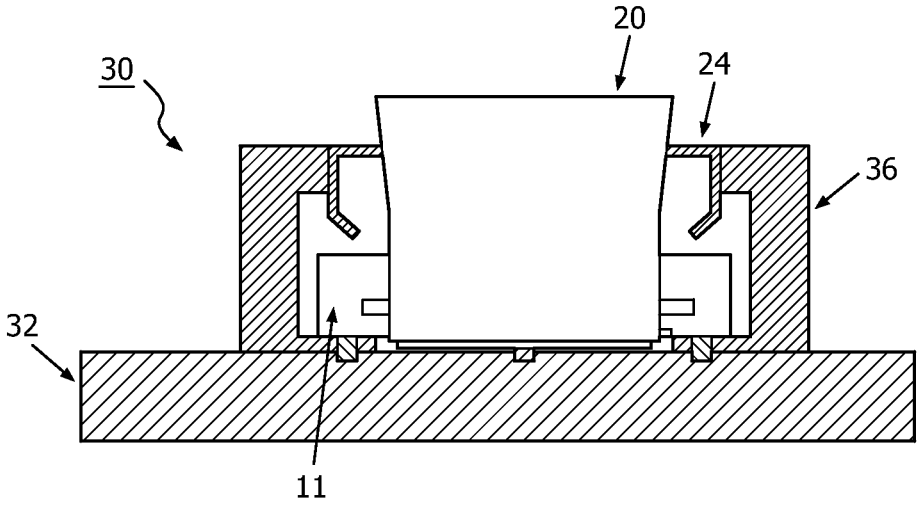

The following embodiments of the present invention that will be described in relation to FIGS. 11 and 12 are in most aspects similar to the above described embodiment in FIG. 10. Only differences will be discussed in the following.

FIG. 11 is a schematic side view of an embodiment of a luminaire arrangement 30 according to the present inventive concept. In this embodiment, the covering 24 on the luminaire module 20 is an integrated covering arrangement 34 comprising the covering and at least one gasket 15. In this embodiment, the integrated covering arrangement 34 is a rubber skirt placed around the luminaire module 20.

FIG. 12 is a schematic side view of an embodiment of a luminaire arrangement 30 according to the present inventive concept. In this embodiment, the shield on the luminaire holder is an integrated shield arrangement 36 comprising the grommet seals 14, the seal and at least one gasket.

According to an embodiment, the at least one gasket can be arranged between the luminaire holder 10 and the ground plane 32.

According to another embodiment, the at least one gasket can be attached to the ground plane 32.

The luminaire holder 10 can as previously described be arranged to be attached to the ground plane 32 and to comprise electrical circuitry connectors 12, grommet seals 14 provided on the electrical circuitry connectors 2, and a shield 18. The luminaire holder 10 can be arranged to form part of a luminaire arrangement 30, as described above in relation to FIGS. 10-12.

The luminaire module 20 can as previously described be arranged to emit light through a light-emitting aperture and to be received in a luminaire holder 20 and to comprise a covering 24. The luminaire module 20 can be arranged to form part of a luminaire arrangement 30 as described above in relation to FIGS. 10-12.

The luminaire module 20 according to the present inventive concept can be arranged to be received in a prior art luminaire holder 1.

A prior art luminaire holder 1 can be arranged to receive a luminaire module 20 according to the present inventive concept.

In this way, it may be possible to combine high IP rated modules with low IP rated holders, and vice versa.

Further, a luminaire can comprise an arrangement 30 according to any one of the luminaire arrangements described above in relation to FIGS. 10-12. Such a luminaire can comprise the ground plane 32 and the luminaire holder 10. In addition, such a luminaire can optionally have more parts, such as covers or rings to integrate and mount the luminaire onto for example a ceiling or a wall. When such a luminaire is assembled in a factory, it is not necessarily required that either the ground plane or the luminaire holder comprises such protective rings. Therefore, separate protective rings could optionally be used when assembling the luminaire.

In summary there has been disclosed a luminaire arrangement 30 comprising a luminaire holder 10 and a luminaire module 20. The luminaire holder 10 is arranged to be attached to a ground plane 32 and comprises electrical circuitry connectors 12, grommet seals 14 provided on said electrical circuitry connectors 12, and a shield 18. The luminaire module 20 comprises a covering 24 and is arranged to be received in the luminaire holder 10. The shield 18 and the covering 24 are arranged to form a sealing arrangement between the luminaire holder 10 and the luminaire module 20, when the luminaire module 20 is received in the luminaire holder 10.

The person skilled in the art realizes that the present invention by no means is limited to the preferred embodiments described above. On the contrary, many modifications and variations are possible within the scope of the appended claims. For example, the disclosed arrangement may be part of a LED light source. Thus, a LED light source may comprise one or more arrangements as disclosed above. Similarly, the disclosed arrangement may be part of a luminaire.

The invention claimed is:

1. A luminaire arrangement, comprising: a luminaire holder configured to be attached to a ground plane, and said luminaire holder comprising a base upon which electrical circuitry connectors are arranged, grommet seals provided on said electrical circuitry connectors, and a shield arranged on the base and around the luminaire holder, wherein the shield includes a top surface, and a light-emitting diode module received in the luminaire holder and comprising a plurality of light-emitting diodes, wherein said light-emitting diode module further comprises a bottom surface facing the base, a top surface opposite the bottom surface, a side surface, and a skirt-shaped covering, wherein the top surface includes a light-emitting aperture formed therein, said skirt-shaped covering is arranged around the light-emitting diode module and connected to the side surface between the top surface of the light-emitting diode module and the bottom surface, the skirt-shaped covering further comprising a first portion extending from a first end connected to the side surface toward a second end adjacent to the shield, a second portion extending from the second end toward a third end adjacent to the base, and a third portion extending from the third end away from the second portion at an angle toward a fourth end, and a first watertight interface is formed between a first portion of the shield and the second portion of the skirt-shaped covering, the first watertight interface comprising a connection between said first portion of the shield and at least a portion of said second portion of the skirt-shaped covering, and wherein the skirt-shaped covering is positioned at or below the top surface of the shield, wherein said shield and said skirt-shaped covering are arranged to form a sealing engagement between said luminaire holder and said light-emitting diode module, wherein said sealing engagement between said luminaire holder and said light-emitting diode module is formed such that said light-emitting aperture remains uncovered;

wherein a second watertight interface is attached to a second portion of said shield, said second watertight interface and said second portion of said shield are formed between said ground plane and the base of the luminaire holder.

2. The luminaire arrangement according to claim 1, wherein at least one said first watertight interface or said second watertight interface comprises at least one gasket.

3. The luminaire arrangement according to claim 1, wherein said first watertight interface comprises at least one gasket attached to said second portion of the skirt-shaped covering.

4. The luminaire arrangement according to claim 1, wherein said second watertight interface comprises at least one gasket.

5. The luminaire arrangement according to claim 4, wherein said at least one gasket is configured to attach to said ground plane.

6. A luminaire comprising an arrangement according to claim 5.

7. A luminaire arrangement, comprising: a luminaire holder configured to be attached to a ground plane, said luminaire holder comprising a base upon which electrical circuitry connectors are arranged, grommet seals provided on said electrical circuitry connectors, and a shield arranged on the base and around the luminaire holder, wherein the shield includes a top surface, and a light-emitting diode module received in the luminaire holder and comprising a plurality of light-emitting diodes, wherein said light-emitting diode module further comprises a bottom surface facing the base, a top surface opposite the bottom surface, a side surface, and a skirt-shaped covering arranged around the light-emitting diode module, said skirt-shaped covering is connected to the side surface between the top surface of the light-emitting diode module and the bottom surface, wherein the top surface of the light-emitting diode module includes a light-emitting aperture formed therein, said skirt-shaped covering further comprising a first portion extending from a first end connected to the side surface toward a second end adjacent to the shield, a second portion extending from the second end toward a third end adjacent to the base, and a third portion extending from the third end at an angle away from the second portion towards to a fourth end, wherein said second portion of the skirt-shaped covering is connected to the shield, and wherein the skirt-shaped covering is positioned at or below the top surface of the shield, wherein the skirt-shaped covering forms a first watertight interface between said luminaire holder and a first portion of the shield, wherein a second watertight interface is attached to a second portion of said shield, said second watertight interface and said second portion of said shield are formed between said ground plane and the base of the luminaire holder; and wherein said shield and said covering are arranged to form a sealing engagement between said luminaire holder and said light-emitting diode module; and wherein said sealing engagement between said luminaire holder and said light-emitting diode module is formed such that said light-emitting aperture remains uncovered.

8. A luminaire arrangement, comprising: a luminaire holder configured to be attached to a ground plane, said luminaire holder comprising a base upon which electrical circuitry connectors are arranged, grommet seals provided on said electrical circuitry connectors, and an integrated shield arrangement formed as a single continuous component, said integrated shield arrangement comprising a shield, a seal, at least one gasket, and said grommet seals, wherein said shield is arranged on the base and around the luminaire holder, wherein the shield includes a top surface, and said seal is positioned between said base and said ground plane, said seal is configured to form a sealing engagement between said luminaire arrangement and said ground plane, and a light-emitting diode module received in the luminaire holder and comprising a plurality of light-emitting diodes, wherein said light-emitting diode module further comprises a bottom surface facing the base, a top surface opposite the bottom surface, a side surface, and a skirt-shaped covering, wherein the top surface of the light-emitting diode module includes a light-emitting aperture formed therein, wherein said skirt-shaped covering is arranged around the light-emitting diode module and connected to the side surface of the light-emitting diode module between the top surface and the bottom surface, wherein the skirt-shaped covering is positioned at or below the top surface of the shield, and said skirt-shaped covering further comprising a first portion extending from a first end connected to the side surface toward a second end adjacent to the shield, a second portion extending from the second end toward a third end adjacent to the base, and a third portion extending from the third end at an angle away from the second portion toward a fourth end, wherein a watertight interface is formed between the shield and the second portion of the skirt-shaped covering, the watertight interface comprising a connection between the shield and at least a portion of said second portion, wherein said watertight interface formed between the shield and the second portion of the skirt-shaped covering is configured to form a sealing engagement between said luminaire holder and said light-emitting diode module; and wherein said sealing engagement between said luminaire holder and said light-emitting diode module is formed such that said light-emitting aperture remains uncovered.

* * * * *